US005403220A

United States Patent [19]

Goad, Sr.

[11] Patent Number: 5,403,220

[45] Date of Patent: Apr. 4, 1995

[54] JET-PROPELLED CHAIR FLOAT

[76] Inventor: Christopher F. Goad, Sr., Rte. 1, Box 57J, Fork Union, Va. 23055

[21] Appl. No.: 113,986

[22] Filed: Aug. 30, 1993

[51] Int. Cl.[6] ..... B63C 9/08

[52] U.S. Cl. ..... 441/130; 440/6; 440/38

[58] Field of Search ..... 441/130–132, 441/35, 129; 440/6, 38; 114/344, 361, 61, 363

[56] References Cited

U.S. PATENT DOCUMENTS

| | | | |
|---|---|---|---|
| 714,650 | 11/1902 | Truscott | 114/361 |
| 3,117,327 | 1/1964 | Mathew | 441/132 |
| 3,721,208 | 3/1973 | Lampert et al. | 115/6.1 |
| 3,792,502 | 2/1974 | Odegaard | 114/344 |
| 4,115,888 | 9/1978 | Sievers | 441/132 |
| 4,311,108 | 1/1982 | Horton | 114/61 |
| 4,662,852 | 5/1987 | Schneider et al. | 441/132 |
| 4,700,648 | 10/1987 | Trefethern et al. | 114/61 |
| 4,730,571 | 3/1988 | Hedlund et al. | 440/6 |
| 4,799,910 | 1/1989 | Kellough | 441/131 |
| 4,807,552 | 2/1989 | Fowler | 114/151 |
| 4,827,859 | 5/1989 | Powell | 114/61 |

FOREIGN PATENT DOCUMENTS

| | | | |
|---|---|---|---|
| 1087797 | 10/1967 | United Kingdom | 440/38 |

*Primary Examiner*—Edwin L. Swinehart
*Attorney, Agent, or Firm*—John F. C. Glenn

[57] ABSTRACT

A floating chair moves forward, turn or drifts under control of a pair of on/off switches connecting a rechargable battery to power a pair of sump pumps which jet water from the rear of a pair of elongated floats supporting the chair. The battery is in a float which is behind the chair and extends between the elongated floats. A buoyant roller beneath the floats enable the unit to roll on dry land.

2 Claims, 7 Drawing Sheets

JET-PROPELLED CHAIR FLOAT

FIELD OF THE INVENTION

Powered chair floats for recreational use in pools.

BACKGROUND OF THE INVENTION

It is well-known to mount a reclining chair between a pair of parallel elongated floats which are integral with a transverse float supporting the backrest of the chair, and also to extend a leg supporting portion of the chair beyond the forward end of the elongated floats. Such floating chairs have been used to float freely in a pool, or to move with the aid of manual locomotion, such as by hand-held or foot-rotated paddles. Internal combustion and electric powered marine propulsion equipment is well known for various boats, but such equipment appears to be unsuitable for meeting the special requirements of floating chairs.

SUMMARY OF THE INVENTION

In accordance with the present invention a person in a floating chair is provided a pair of electrical switches to turn on or off either or both of a pair of battery powered sump pumps which jet water from the rear of a pair of elongated floats supporting the chair, thereby causing the floating chair to move forward, to turn in either direction, or to drift without power.

A sunshield is mounted over the backrest, and the water jets may be used to maneuver the chair to allow the person in the chair to control the person's exposure to sunlight. When full sun is desired the sunshield may be swung out of the way with or without supplemental use of the jets.

A buoyant roller is mounted under the chair and supporting floats, to adjust the fore and aft trim of the floating chair when it is afloat, and to allow a person to roll the unit along when it is out of the water adjusting the angle of the unit so that only the roller touches the ground.

The floating chair of the invention is powered by a low-voltage (e.g., 12 volt) rechargeable battery mounted in a waterproof compartment in the transverse float member. Such a battery is relatively light-weight and can readily be removed and carried away for recharging. The roller facilitates moving the floating chair to dry land before recharging the battery in its compartments, or removing it for recharging, in the interest of safety.

Sump pumps are used in accordance with the invention for purposes of producing the necessary jet action, because such pumps are relatively small and light-weight, are immersible in water, are readily available, are inexpensive, and can operate off a 12 V battery to deliver water jets useful for maneuvering a floating chair in an average swimming pool.

These and other details, objects and advantages of the invention will become apparent as the following disclosure proceeds.

BRIEF DESCRIPTION OF THE DRAWINGS

A present preferred embodiment of the invention, is shown in the accompanying drawings, in which.

DETAILED DESCRIPTION OF PRESENT PREFERRED EMBODIMENT

Figure 1:
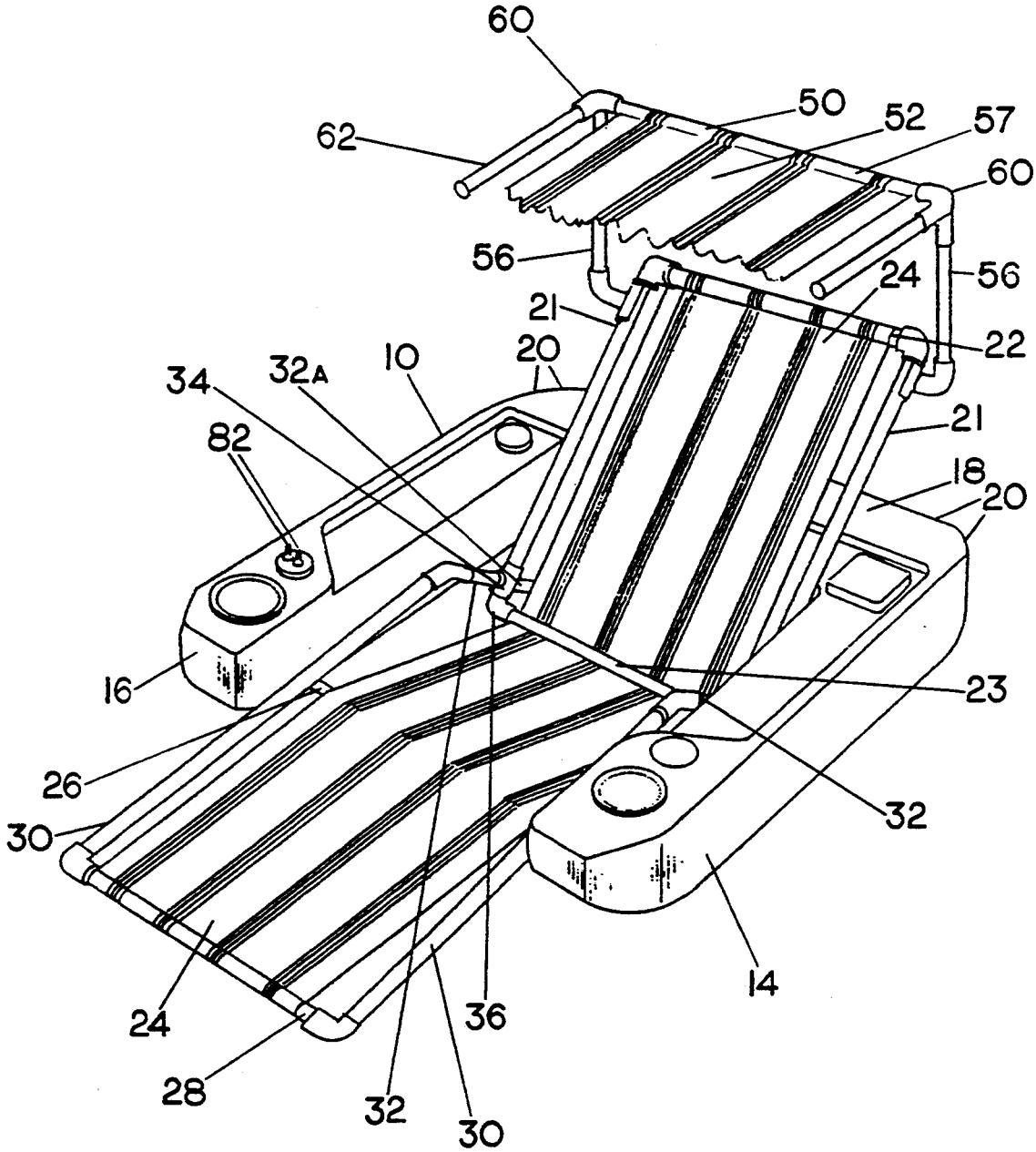
FIG. 1 is a partially broken away isometric downward view toward the floating end of a floating chair in accordance with the invention.
Figure 2:
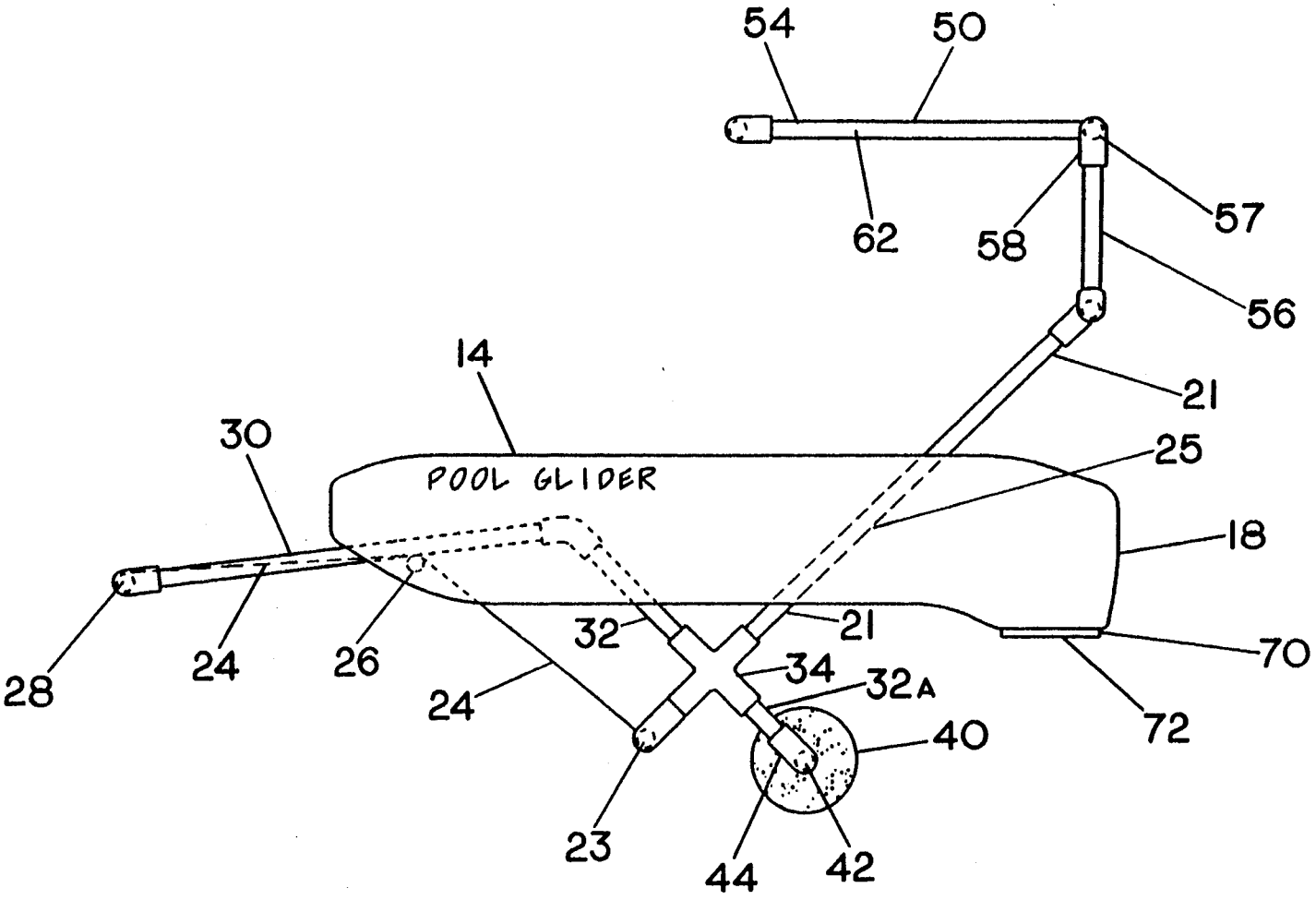
FIG. 2 is an enlarged side view of the floating chair of FIG. 1.
Figure 3:
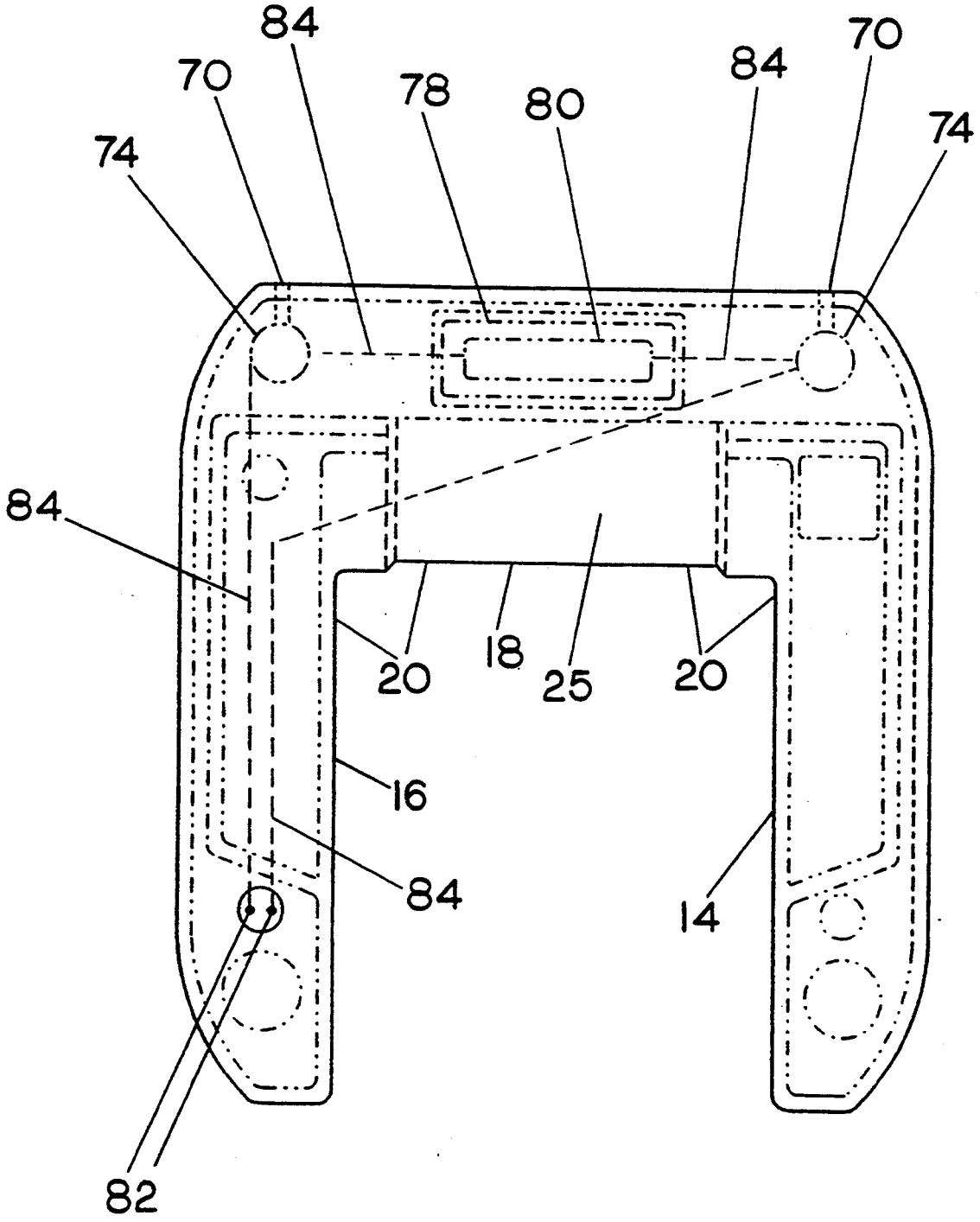
FIG. 3 is a top view of what is shown in FIG. 2, but omitting the chair and attached roller.

Referring now to the accompanying drawing, and initially to FIG. 1, a floating chair 10 has a chair 12 mounted between a pair of elongated parallel side floats 14 and 16. The back of the chair is supported by a float 18 extending transversely between the rear ends of side floats 14 and 16. The floats 14, 16, and 18 are preferably spun cast of molded polystyrene polymer in an integral, unitary, rigid, hollow, and water tight hull 20. The sidebars and crossbars of chair 12 are tubular, and substantially all of the chair frame is made of vinyl polymer.

The chair 12 has a back-supporting rear portion comprising a pair of parallel spaced sidebars 21 joined at their opposite ends by an upper crossbar 22 and a lower crossbar 23. A length of fabric 24 is secured at one end to the higher crossbar 22 and extends diagonally downward to bend around the lower crossbar 23. Part of the fabric between crossbars 22 and 23 overlies a sloping surface 25 which is formed in the transverse float 18 and which supports sidebars 21 and the back of a person seated in the chair.

After bending around the lower crossbar 23, the fabric 24 extends diagonally upward until it bends over a crossbar 26 secured at its opposite ends to side floats 14 and 16 near their forward ends. This intermediate portion of the fabric supports the butt end of a person seated in the chair.

After bending around crossbar 26, the fabric 24 slopes downwardly and at its lower end is secured to a crossbar 28 extending between a pair of parallel sidebars 30 where their forward ends project beyond the forward ends of side floats 14 and 16. The knees of a person seated in the chair ordinarily overlie crossbar 26, and the part of the fabric 24 between crossbars 26 and 28 supports the legs below the knees of a person seated in the chair. An intermediate part of each of the crossbars 30 rests on and is secured to crossbar 26. A pair of sidebars 32 have their forward ends joined by an angular fitting to the rear ends of sidebars 30, and their rear ends joined to a pair of cross-shaped fittings 34 which are connected between sidebars 32 and their extensions 32a, and between the lower ends of sidebars 21 and a pair of fittings 36 formed to the opposite ends of crossbar 23.

A cylindrical roller 40 extends around a crossbar 42. The opposite ends of crossbar 42 turn in sockets in a pair of fittings 44 mounted at the lower ends of sidebar extensions **32*a*. Roller 40 is made of foam plastic which is buoyant and thus helps to support the chair and person in it while afloat. Roller 40** also serves to roll the whole assembly over dry land as hereinafter described.

Figure 6:
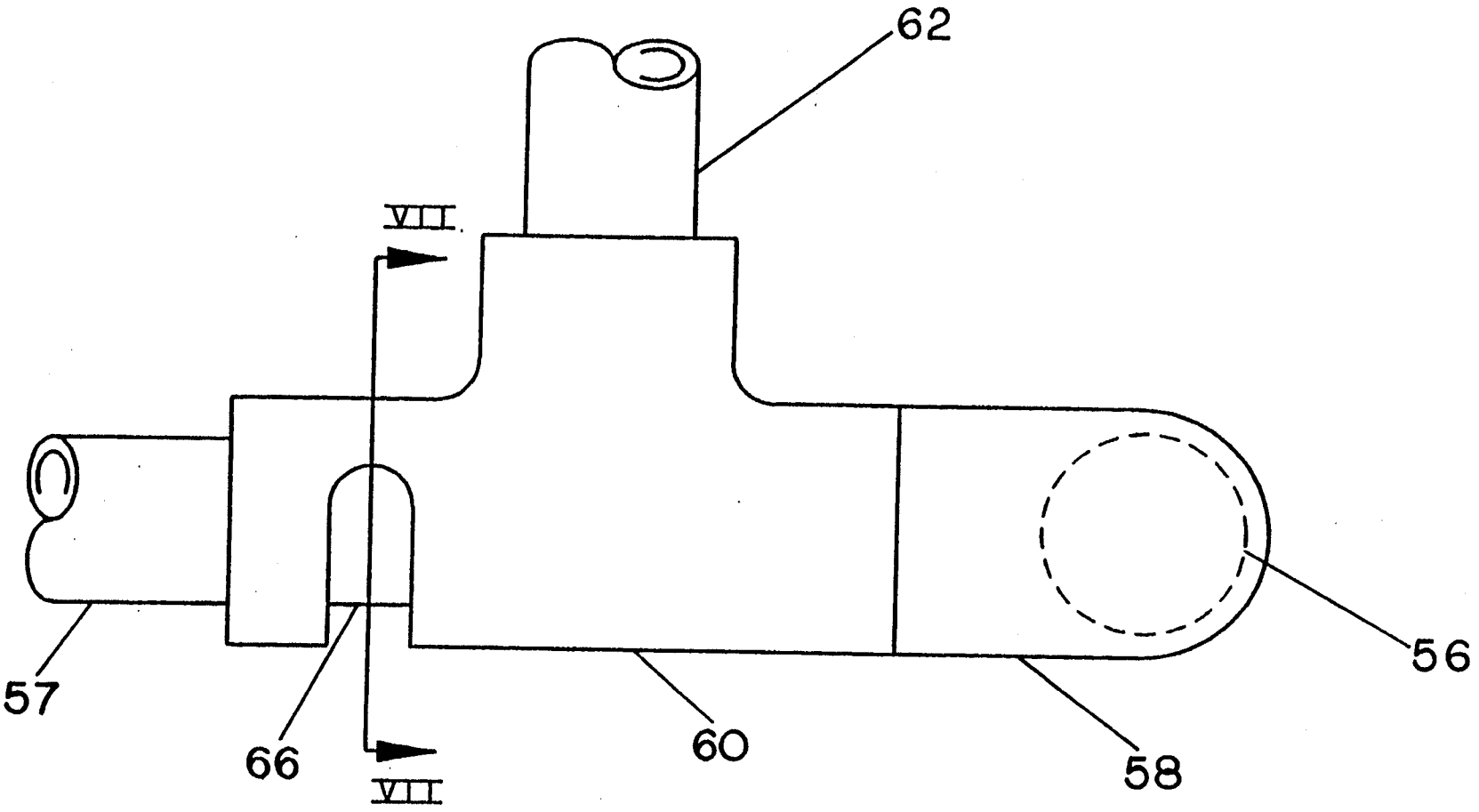
FIG. 6 is a further enlarged and partially broken away view of one of the frame connections shown in FIG. 5.
Figure 7:
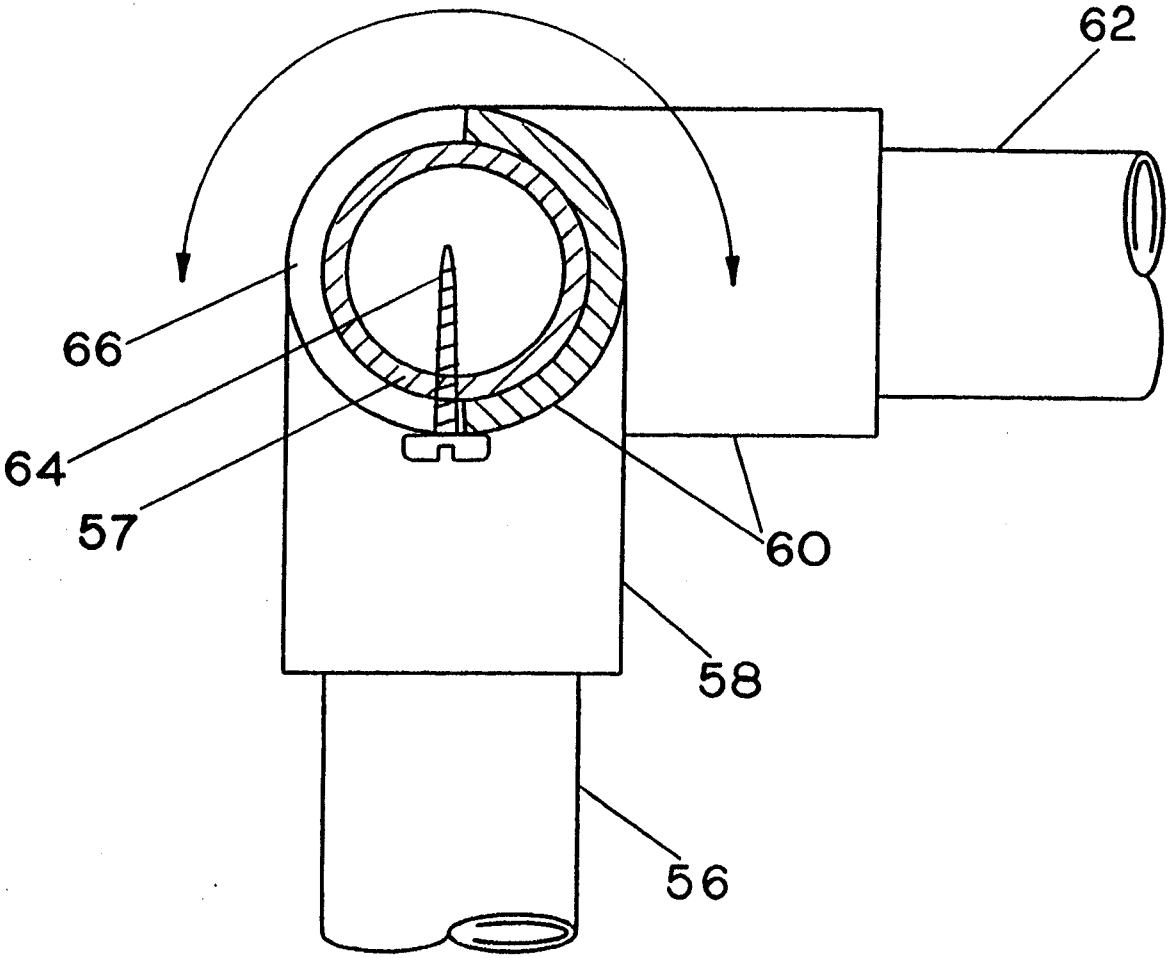
FIG. 7 shows a section through the line VII—VII in FIG. 6.

A sunshield 50 in the form of fabric 52 is stretched over a rectangular frame 54 supported by a pair of parallel vertical bars 56 secured at their lower ends to the upper ends of sidebars 21. Frame 54 has a rear crossbar 57 with ends which are fixed in fittings 58 secured to the upper ends of support bars 57. A pair of T-shaped fittings 60 are mounted next to fittings 58 and each has one leg rotatable around rear crossbar 56. The other leg of each fitting 60 is secured to an end of one of a pair of sidebars 62 of frame 54. This enables sunshield 50 to swing between a position in which it projects substantially horizontally forward over the head and back-supporting portion of chair 12 for sunshielding purposes, and a position extending substantially horizontally to the rear of the first position, where it has little or no sunshielding effect. The swinging movement of the sunshield 50 is in an arc extending above its forward and retracted positions, and is stopped at each end by a screw 64 extending from crossbar 57 through a slot 66 in each of the fittings 60 (FIGS. 6 and 7).

Crossbar 57 of sunshield 50 is below waist level of an average person standing up and grasping it to roll the unit over the ground on roller 40, and provides the most convenient handle for that purpose. When the unit is unoccupied and resting on the ground, the weight of the rear end components causes the front end of the unit to tilt up on roller 40 until the rear end of hull 20 rests on the ground. Therefore, crossbar 57 is normally lifted to roll the unit on roller 40. When afloat, crossbar 57 is positioned to make sunshield 50 effective in its forward position for shading overhead sun from the face of an average person reclining in chair 12.

The hull 20 is propelled by jets of water to the rear from a pair of jet ports 70 mounted on a pair of downward projection 72 from the rear ends of side floats 14 and 16. The ports 70 are each slightly elongated horizontally, and are connected to the outlets of a pair of sump pumps 74 secured in inverted wells 76 formed in the respective side floats 14 and 16 and extending upwardly from openings through the projections 72. The built-in output ports of the pumps 74 extend tangentially from the sides of their cases, and hence one of the wells 76 must be offset to one side in order to have the ports 70 spaced equally from the sides of floats 14 and 16.

Figure 4:
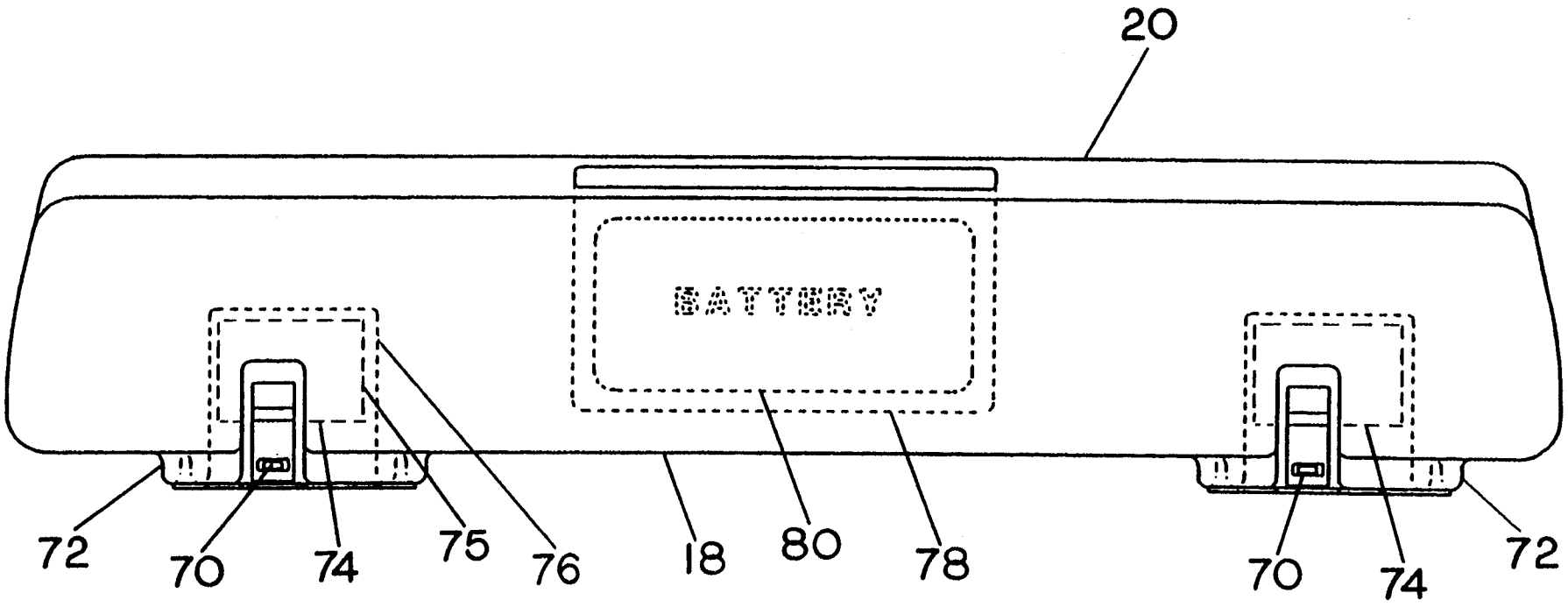
FIG. 4 is an end view of the rear of what is shown in FIG. 3.
Figure 5:
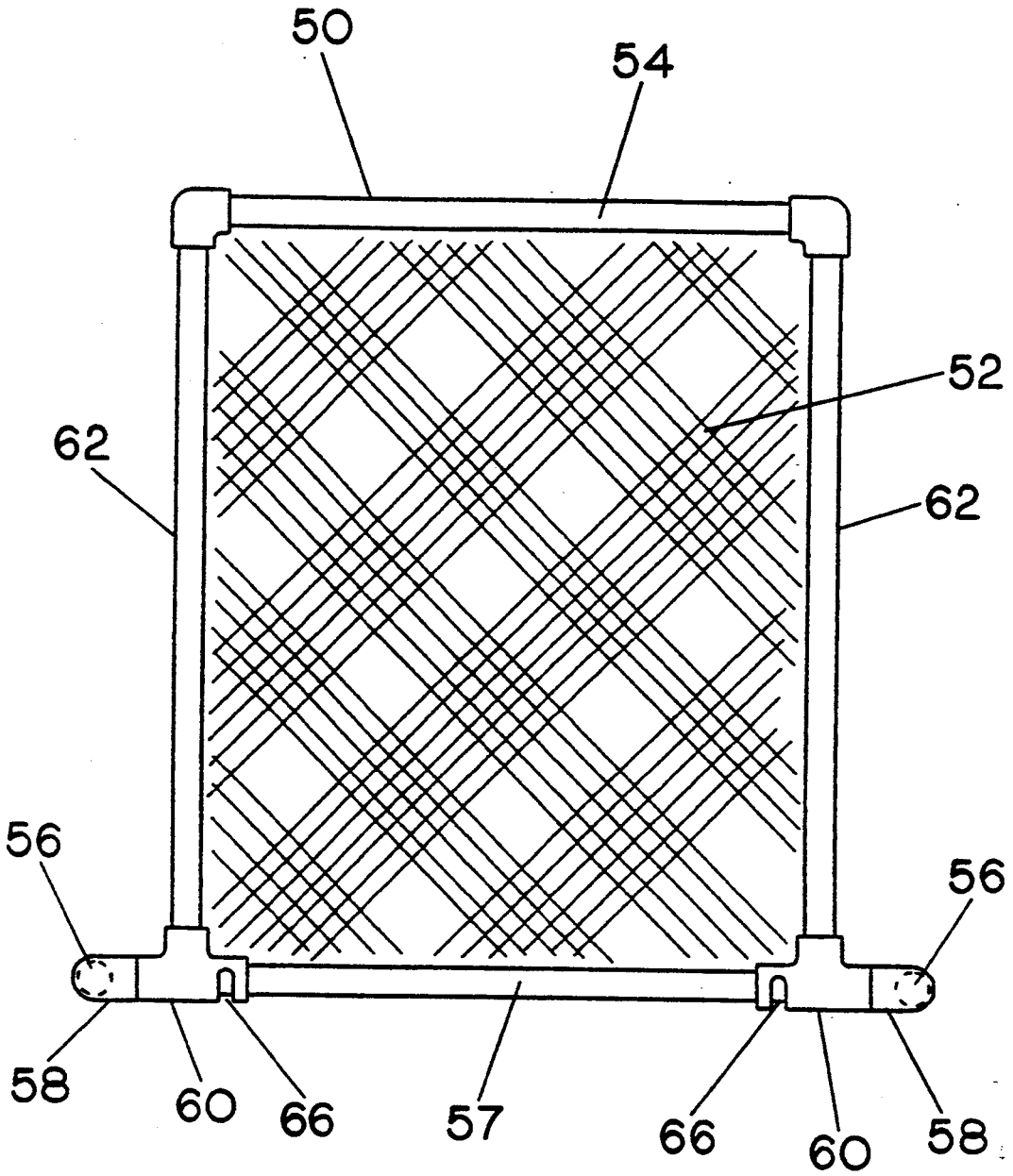
FIG. 5 shown an enlarged top view of the sunshade mounted on the chair, including its frame and its connection to its support.

A downwardly extending well 78 in the center of transverse 18 has a removable cover and receives a rechargeable nickel-cadmium 12 volt battery 80 to power the built-in electric motors 73 of pumps 74. Battery 80 has a 3 to 4 hour charge life, and an 8 to 12 hour recharge period. The pumps 74 are conventional sump pumps and each has an outer case 73 which keeps water from reaching the pump's motor or its electrical connections while the pump is immersed in water, but receives water through the inlets of the pump while it is immersed in water entering one of the wells 76, and emits water form the pump impeller through the pump outlet 71 (FIG. 8) thereby supplying water for the outflow from one of the jet ports 70 (FIG. 4). Each pump has an outflow of about 1100 gallons per hour. The combined outflow from both pumps is sufficient to move the floating chair across a swimming pool at about swimming speed, and the outflow from one pump acting alone is sufficient to quickly turn the boat for a change of course or to align the person in the chair relative to the sun except when the sun is directly overhead.

A pair of electrical on/off switches 82 are separately operable and separately connect the power units of pumps 70 with battery 80 through two sets of electrical lines 84 extending through the interior of hull 20 and into battery well 78. Switches 82 are mounted next to each other on the forward end of side float 16, on the right side of hull 20 when looking forward, in a position readily reached by the right hand of a person in chair 12. Parallel switches may also be mounted on the forward float 14, if desired. The battery well 78 and electrical lines 84 and their connections with battery 80, switches 82 and pumps 74 are all sealed against entry of water and other causes of short circuits which might be hazardous or run down battery 80.

While present preferred embodiments and methods of the invention have been illustrated and described, it will be understood that the invention is not limited thereto but may be otherwise variously embodied and practiced.

I claim:

1. Powered chair float apparatus comprising a hull having a pair of spaced parallel elongated hull portions having forward and rear ends, and a third hull portion extending transversely between said hull portions, a chair mounted between said elongated hull portions, said chair having a backrest extending over said transverse hull portion, and means to propel and steer the boat comprising a pair of water-submersible sump pumps mounted in the rear of said elongated hull portions where the pumps can be submerged in water while the hull is afloat, each of said sump pumps having a water impeller, an electric motor connected to drive the impeller, and a case which protects the motor from water while the pump is submerged, said case having water outlet means to conduct water from the impeller, a pair of outlet ports each mounted in the rear of one of the elongated hull portions, means connecting each of said pump outlet means to one of said outlet ports in the rear of said pair of hull portions, a battery connected to power said motor of each pump, and a separately operable switch to connect and disconnect the battery from each pump.

2. Apparatus according to claim 1, comprising a sunshield panel, means mounting the panel above and at least partially over said backrest, and a roller mounted beneath the hull and chair and extending transversely between said pair of hull portions, said roller being capable of supporting said apparatus while rolling the apparatus on the ground and said sunshield panel supporting means being graspable by a person standing on the ground to cause the apparatus to roll on the roller.

* * * * *